United States Patent [19]

Erhardt et al.

[11] Patent Number: 5,032,767

[45] Date of Patent: Jul. 16, 1991

[54] HIGH FREQUENCY OSCILLATOR-INVERTER WITH IMPROVED REGENERATIVE POWER SUPPLY

[75] Inventors: Robert A. Erhardt, Chicago; Allan E. Brown, Lake Zurich, both of Ill.

[73] Assignee: North American Philips Corporation, New York, N.Y.

[21] Appl. No.: 549,340

[22] Filed: Jul. 6, 1990

[51] Int. Cl.[5] ..... H05B 41/14

[52] U.S. Cl. ..... 315/219; 315/223; 315/DIG. 7

[58] Field of Search ..... 315/205, 206, 219, 223, 315/283, 307, 324, DIG. 5, DIG. 7

[56] References Cited

U.S. PATENT DOCUMENTS 4,560,908 12/1985 Stupp et al. ..... 315/219

*Primary Examiner*—David Mis

*Attorney, Agent, or Firm*—Bernard Franzblau

[57] ABSTRACT

An improved power supply for one or more electric discharge lamps includes a high frequency oscillator-inverter circuit coupled to the output of a full-wave rectifier circuit via a transformer primary winding (25). The rectifier circuit is energized from a low frequency source of AC voltage. The oscillator-inverter circuit supplies high frequency oscillations to the lamp via a frequency-dependent ballast coupling circuit. A regenerative power supply is coupled to the transformer primary winding by means of a secondary winding (62) of the transformer thereby to charge a capacitor (49) operative as a switchable auxiliary supply voltage for the oscillator-inverter circuit. Improved start-up operation is achieved by winding the transformer (25, 62) so as to provide a polarity inversion for the supply of electric energy to the regenerative power supply.

9 Claims, 1 Drawing Sheet

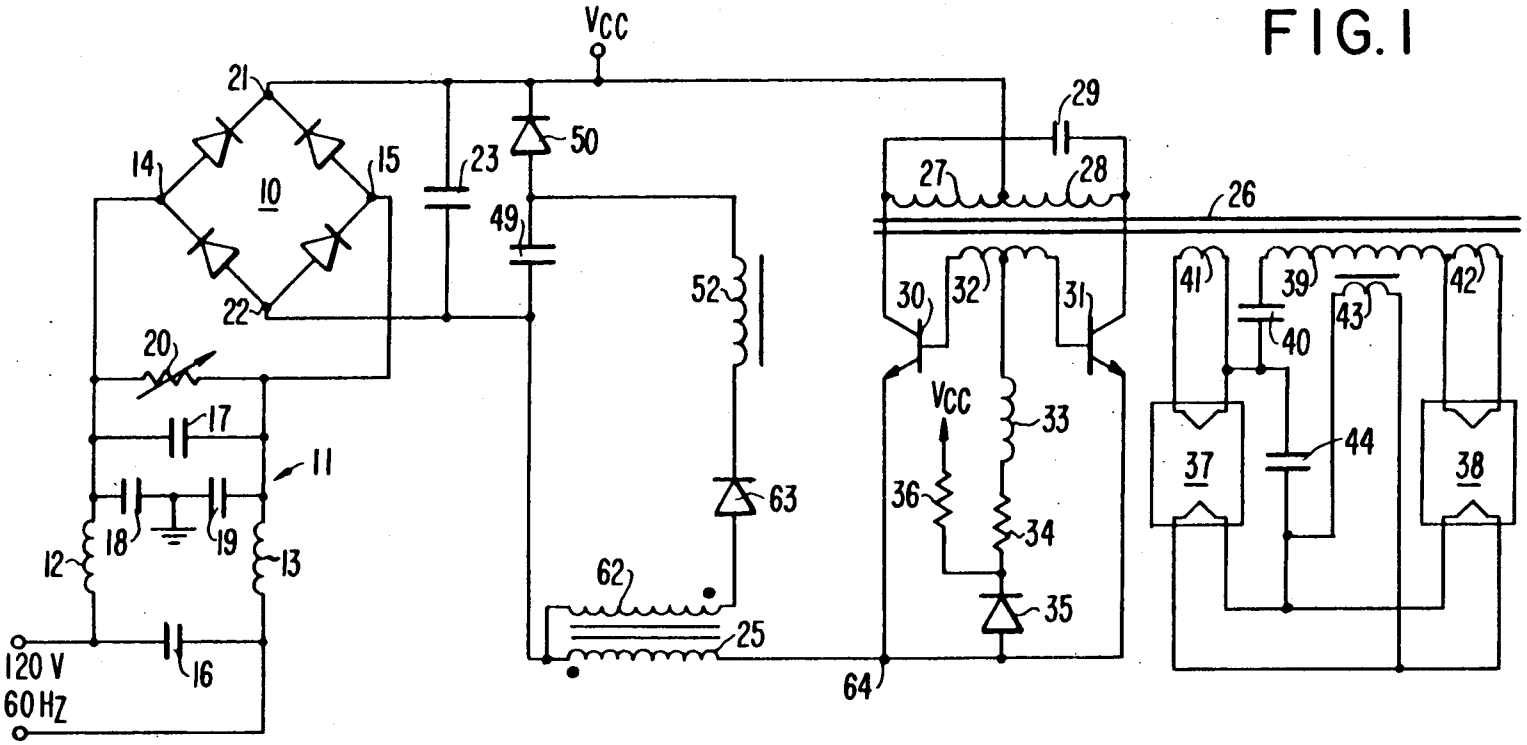
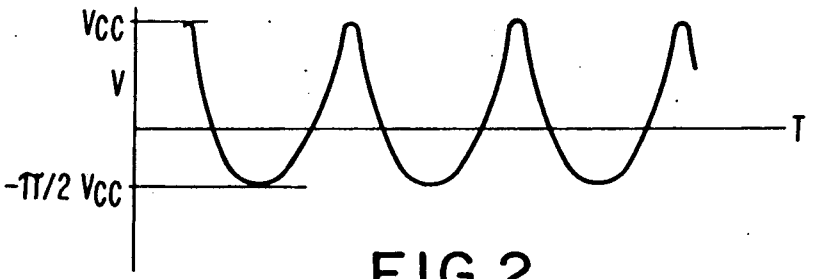
FIG. 2

HIGH FREQUENCY OSCILLATOR-INVERTER WITH IMPROVED REGENERATIVE POWER SUPPLY

BACKGROUND OF THE INVENTION

This invention relates to a high efficiency, high frequency electronic oscillator-inverter circuit for starting and operating one or more electric discharge lamps. More particularly, the invention relates to a high frequency oscillator-inverter ballast circuit with an improved regenerative power supply.

U.S. Pat. No. 4,560,908 (12/24/85; Stupp et al) describes a high frequency oscillator-inverter circuit for starting and ballasting one or more discharge lamps and which includes a novel regenerative power supply. The Stupp et al apparatus exhibits a high efficiency and very high system power factor along with automatic regulation of the lamp current, reduced third harmonic distortion and substantial elimination of radio frequency interference (RFI). A limitation of this system is that at start-up, the circuit will sometimes go into an abnormal mode of operation during which both of the switching transistors simultaneously turn-off, whereupon the feedchoke which supplies energy to the oscillator-inverter will "fly-back" thereby generating a high voltage which overstresses the switching transistors such that they suffer severe damage, sometimes even causing complete destruction thereof.

One solution to this problem was to provide a transient absorption element, for example, a zener diode, which is coupled to the feed-choke to dissipate the fly-back energy generated therein during the start-up period. This approach is not entirely satisfactory since the zener diode or the like increases the cost of the apparatus. Furthermore, it is not entirely reliable because the fly-back voltage which will be generated, and must be dissipated, is not always easy to define in advance. Therefore, it requires considerable design and test time to determine the proper value of the zener diode, which further adds to the system cost.

In U.S. Pat. No. 4,560,908 (hereby incorporated by reference), the ballast system was provided with a regenerative power supply in order to supply power to the oscillator-inverter during the time period when the rectified unfiltered line voltage dropped below a given threshold value. In that system the regenerative power supply derived its energy from the main transformer of the high frequency oscillator-inverter. It has now been discovered that as a result of this method of operation, particularly at start-up of the high frequency oscillator-inverter, the primary winding of the main transformer was clamped to a voltage level which prevented the transfer of sufficient energy to the base drive winding of the switching transistors so as to maintain proper circuit oscillation. As mentioned above, the result of all of this will cause an abnormal mode of operation in which both switching transistors turn off and the feed-choke generates a high voltage which will damage the transistors unless the energy is dissipated by a transient absorption device.

It was further discovered that the start-up problem was due to the fact that the voltage of the resonant tank circuit of the oscillator-inverter was clamped to a low voltage by the feedback winding and by the input capacitor. The normal operating voltage of the capacitor is about 100 volts, but at start-up it is zero volts. A net DC current builds up in the feedchoke during start-up, and if the circuit is not able to sustain oscillation due to the lack of transferred drive current from the tank circuit to the transistors, both transistors turn off and a high flyback voltage is produced across the feedchoke in response to the abruptly diminished current therein. The flyback voltage must be clamped, and the energy in the feedchoke dissipated to protect the transistors and other circuit components.

Another possible solution to the above problem is to provide an auxiliary circuit which will pre-charge the power factor (PF) supply capacitor. This too is not an optimum solution because the auxiliary pre-charge circuit requires extra components which in turn increase the cost of the high frequency oscillator-inverter.

SUMMARY OF THE INVENTION

It is therefore an object of the present invention to provide a high-frequency oscillator-inverter ballast circuit with improved start-up characteristics.

Another object of the invention is to provide a high frequency oscillator-inverter ballast circuit in which the start-up characteristic is improved, but without the added cost of additional circuit components.

In accordance with the invention, a better solution to the start-up problem is to provide a polarity inversion technique in which energy is supplied to the power factor capacitor of the regenerative power supply when the voltage across the parallel resonant tank circuit of the oscillator-inverter is near its peak amplitude. As a result of this discovery, the switching, i.e. the base drive to the transistors, is not disrupted as in the prior art oscillator-inverter circuit. More particularly, the feedback winding of the regenerative power supply and the feed-choke are decoupled from the main transformer of the oscillator-inverter circuit and the feedback winding is magnetically coupled instead to the feed-choke winding alone. The feed-choke winding and feedback winding together form a transformer in which the feedchoke winding is the primary and the feedback winding is the secondary. The feedback winding is coupled to the power factor capacitor by a rectifier element and an inductor. These two transformer windings are wound out of phase with respect to a common connection point thereof.

The voltage which appears across the feed-choke now has the form of a full-wave rectified sine wave which varies between the value of the supply voltage, $V_{cc}$, and a more negative voltage of $$-\frac{\pi}{2}$$

Vcc. As a result of the above described circuit modifications, energy is transferred to the PF capacitor (49) only on the negative portion of the full-wave rectified waveform. This mode of operation allows a sufficient transfer of energy from the primary winding of the main transformer of the oscillator-inverter to the base drive winding, which is coupled to the base electrodes of the switching transistors, so as to maintain the normal mode of oscillation of the oscillator-inverter circuit during the start-up phase. Thus, during start-up, the power factor capacitor is charged at or near the peak of the line voltage, which thus allows the oscillator-inverter tank circuit to reach a higher voltage. By not clamping the tank circuit, sufficient energy is transferred to the transistor drive circuitry to sustain oscillation and therefore the circuit does not exhibit the abnormal start-up operation of the prior art circuit.

BRIEF DESCRIPTION OF THE DRAWINGS

The above and other objects and novel features of the invention will best be understood by reference to the following detailed description of a preferred embodiment taken in conjunction with the accompanying drawing, in which:

FIG. 1 is a circuit diagram showing an apparatus in accordance with the invention for operating a pair of discharge lamps, and FIG. 2 is a diagram of the voltage waveform which appears across the feed-choke winding.

DESCRIPTION OF THE PREFERRED EMBODIMENTS

Elements of the drawing identical to those in the U.S. Pat. mentioned above bear the same reference numerals and function in a similar manner. FIG. 1 shows a pair of input terminals for connection to a source of low frequency AC supply voltage, e.g. 120 V, 60 Hz. The AC input terminals are coupled to the input terminals 14, 15 of a full wave rectifier bridge 10 via an RFI filter 11. The RFI filter includes a pair of bifilar coils 12 and 13 wound on a magnetic core and each is connected between a respective AC input supply terminal and a bridge input terminal 14 and 15. The coils will attenuate the high frequencies while passing the 60 Hz line current. The RFI filter also includes a capacitor 16 directly connected across the AC input terminals and a capacitor 17 connected across the bridge input terminals. These capacitors provide differential mode rejection of high frequency signals. Capacitors 18 and 19 are connected in series across the bridge input terminals 14 and 15 with a junction point therebetween connected to ground. These capacitors provide common mode filtering and also limit leakage currents. The RFI filter is a basic $\pi$ section low pass filter.

A varistor element 20 is coupled across the bridge terminals 14 and 15 to provide transient voltage suppression. A high voltage transient across the varistor 20 causes its impedance to change from a very high value to a relatively low value which clamps the transient voltage to a safe level.

The bridge rectifier 10 rectifies the 60 Hz AC line voltage applied to the input terminals 14, 15 to derive at its output terminals 21, 22 a pulsating DC output voltage with a 120 Hz ripple. The pulsating DC voltage is partially smoothed by the unique tuned regenerative power supply to be described below. The maximum output voltage at bridge terminals 21, 22 corresponds to the peak voltage of the 60 Hz AC input voltage and the minimum voltage corresponds to a selected value which will insure that the discharge lamps supplied by this power supply do not extinguish at any time during each period of 60 Hz operation.

A small capacitor 23 is coupled across the bridge output terminals to provide RFI suppression as well as transient suppression. The relatively low capacitance value of this capacitor allows the circuit to exhibit a high power factor.

The high frequency oscillator-inverter 27–36 is supplied with the pulsating DC voltage via a direct connection between terminal 21 and a center tap of a primary winding 27, 28 and via a feed-choke 25 connected between terminal 22 of the bridge circuit and a terminal 64 of the oscillator-inverter stage. A capacitor 29 is connected in parallel with the primary winding 27, 28 so as to form a resonant tank circuit with the primary winding inductance. The resonant tank circuit determines the oscillator-inverter oscillation frequency.

A pair of NPN switching transistors 30, 31 have their collector electrodes respectively connected to opposite ends of the primary winding 27, 28 and their emitter electrodes connected to the output terminal 22 of the bridge rectifier 10 via the choke coil 25. The transformer has a secondary winding 32 with its end terminals connected to respective base electrodes of the switching transistors 30 and 31 and with a center tap connected to feed terminal 64 via a series circuit consisting of an inductor 33, a resistor 34 and a diode 35. The winding 32 thus provides the base drive signals for the switching transistors 30 and 31.

A starting resistor 36 couples the DC supply voltage $V_{cc}$ (from terminal 21) to a junction point between resistor 34 and diode 35 thereby to apply the voltage $V_{cc}$ to the base electrodes of the switching transistors in order to start the circuit oscillating. The base drive circuit essentially provides a square wave of current to the transistors so that the transistor switches are alternately driven into a saturation state in their on condition. As the resonant circuit is tuned to the switching frequency, harmonics are removed by it so that the resultant output voltage is essentially sinusoidal. The switching transistors conduct in mutually exclusive time intervals.

A pair of series connected discharge lamps 37 and 38 are coupled to the transformer secondary winding 39 by means of a series ballast capacitor 40. These lamps may be conventional rapid start 40 W fluorescent lamps. The lamp cathodes are heated by means of transformer secondary windings 41, 42 and 43. A capacitor 44 is connected in parallel with the discharge lamp 37 in order to provide sequential starting of the lamps after the cathodes have achieved their proper emission temperatures.

The capacitor 40 operates as a frequency dependent variable impedance connected in series with the discharge lamps so as to ballast the lamps during normal operation thereof by limiting and controlling the lamp current. As described in the U.S. Pat. mentioned above, a change in the operating frequency of the oscillator-inverter circuit will result in a change in the impedance of series capacitor 40 in a direction that tends to maintain the lamp current constant. An inductor could also be used as the frequency dependent impedance element in place of the capacitor 40.

The regenerative power supply consists of a winding 62 which is magnetically coupled to the coil 25 to form an autotransformer therewith. Polarity inversion is obtained by the manner in which these windings are wound, such being indicated by the conventional dot symbols applied to end terminals of the primary (25) and secondary (62) windings of the autotransformer. The secondary winding 62 is coupled via a series circuit consisting of a rectifier diode 63 and an inductor 52 to a junction point between a further series circuit consisting of a capacitor 49 and a diode switch 50. The further series circuit 49, 50 is connected across the DC output terminals 21, 22 of the bridge rectifier circuit 10.

The regenerative power supply charges the capacitor 49 to a given voltage level which is sufficient to maintain oscillations in the oscillator-inverter stage during the period when the pulsating DC supply voltage at terminals 21, 22 drops below said given voltage level. Whenever the DC pulsating voltage at terminals 21, 22 drops below the voltage on the capacitor 49, the diode 50 conducts so that the capacitor 49 then provides a more or less constant DC supply voltage to the center tap of the primary winding 27, 28 of the oscillator stage until the DC pulsating voltage again rises above the voltage of capacitor 49.

It is thus seen that diode 50 functions as a switch which turns on whenever the rectified pulsating DC voltage at terminals 21, 22 is at a voltage level below that of the capacitor 49. During this time period, the diode bridge 10 is back biased thereby effectively isolating the AC power lines from the oscillator-inverter circuit. Energy to drive the oscillator-inverter then is supplied by capacitor 49 via the diode switch 50. When the rectified pulsating DC supply voltage again rises above the voltage stored on capacitor 49, the diode 50 is again back biased so that the regenerative power supply is effectively switched off.

The elements 49, 50, 52, 62 and 63 form a regenerative power supply which is coupled to the feed choke 25 alone, whereas in the aforementioned U.S. Pat., the regenerative power supply was coupled to the main transformer 26. The windings 25 and 62 are wound out of phase with respect to their common end. The voltage appearing across the choke winding 25, i.e. between node 64 and node 22, is shown in FIG. 2 of the drawing. As a result of this novel configuration of elements, electric energy is transferred to capacitor 49 only on the negative portion of the FIG. 2 waveform. This allows sufficient energy transfer from the transformer primary windings 27, 28 to the base drive winding 32 so as to maintain the normal mode of oscillation of the oscillator-inverter circuit during the start-up mode. In contrast to the power supply described in the aforementioned U.S. Pat., the present power supply does not clamp the primary of the main transformer during start up to a low level of voltage which prevents the transfer of sufficient energy to the base drive winding to maintain proper circuit oscillation. The improved circuit described herein does not exhibit the aforesaid abnormal mode of operation during which both of the switching transistors turn off and the feed-choke generates a large flyback voltage.

In the circuit configuration shown in FIG. 1, the capacitor 49 does not clamp the tank circuit at turn on because, inter alia, the phase of the windings 25, 62 and the diode serve to disconnect this capacitor until the voltage across the winding 25 goes negative. Thus, in operation, the voltage across the winding 25 varies in an inverted rectified sine wave fashion as shown in FIG. 2. The peak voltage is approximately equal to $V_{cc}$ when the transistors switch and the minimum voltage is approximately $$-\frac{\pi}{2}$$

Vcc assuming the voltage across capacitor 29 is equal to $\pi V_{cc}$. The only time that the regenerative power supply loads the system is during the negative portion of the waveform shown in FIG. 2.

The manner in which the regenerative power supply automatically varies the oscillation frequency of the oscillator-inverter circuit in a sense to maintain the lamp current constant in the operating condition thereof is described in detail in the aforementioned U.S. Pat.

Although the invention has been described in connection with a preferred embodiment thereof, other modifications and alterations will be readily apparent to persons skilled in the art from the foregoing description and without departing from the spirit and scope of the invention as defined in the appended claims.

What is claimed is:

1. A power supply for an electric discharge lamp comprising:

a pair of input terminals for connection to a low frequency source of AC supply voltage, a rectifier circuit having input means coupled to the input terminals and an output at which a fluctuating unidirectional voltage is developed, a high frequency oscillator-inverter circuit including first and second switchable transistors and a resonant circuit which includes a capacitor and a first winding of a transformer, a frequency-dependent ballast coupling circuit including a second winding of said transformer for coupling high frequency oscillations generated in said high frequency oscillator-inverter circuit to an electric discharge lamp, means, including a third winding of said transformer, for applying out of phase drive signals to control electrodes of the first and second switchable transistors to alternately trigger the transistors into conduction, means, including an inductor, for coupling said oscillator-inverter circuit to said output of the rectifier circuit, an auxiliary power supply comprising a second rectifier circuit that includes a rectifier element, a second capacitor coupled to the rectifier element for deriving a DC voltage sufficient to maintain oscillation of the oscillator-inverter circuit, and means for supplying to said second capacitor, via said rectifier element, a pulsating voltage having an inverted polarity relative to the polarity of current flow in said inductor, and means coupled to said second rectifier circuit and to said oscillator-inverter circuit for switching said auxiliary power supply into and out of circuit with the oscillator-inverter circuit as a function of the voltage level of said fluctuating voltage at the output of the first rectifier circuit.

2. A power supply as claimed in claim 1 wherein said inverted polarity voltage supplying means comprises a second inductor magnetically coupled to the first inductor and electrically coupled to said rectifier element and to said second capacitor.

3. A power supply as claimed in claim 2 wherein said auxiliary power supply switching means comprises a diode coupled to said second capacitor and to the oscillator-inverter circuit.

4. A power supply as claimed in claim 2 wherein said second rectifier circuit comprises a third inductor connected in a series circuit with the rectifier element, the second inductor and the second capacitor.

5. A power supply as claimed in claim 1 wherein said inverted polarity voltage supplying means comprises a second inductor magnetically coupled to the first inductor so as to form an autotransformer having a common node and with said first and second inductors wound out of phase with respect to said common node.

6. A power supply as claimed in claim 5 wherein said ballast coupling circuit further comprises a third capacitor for coupling said second winding of the transformer to an electric discharge lamp.

7. A power supply as claimed in claim 2 wherein the second inductor is magnetically isolated from said transformer.

8. A power supply as claimed in claim 2 wherein said oscillator-inverter circuit produces across the first inductor a full-wave rectified voltage waveform with portions of positive and negative polarity, and wherein the second rectifier circuit transfers electric energy to the second capacitor only on the negative polarity portion of said waveform.

9. A power supply as claimed in claim 1 wherein said inverted polarity voltage supplying means comprises a second inductor magnetically coupled to the first inductor and electrically coupled to said rectifier element and to said second capacitor so as to form therewith a regenerative auxiliary power supply.

* * * * *